United States Patent [19]

Larsen et al.

[11] 4,452,185

[45] Jun. 5, 1984

[54] ENGINE HOUSING

[75] Inventors: Glenn L. Larsen, Bloomington; Jerold F. Patrin, Apple Valley, both of Minn.

[73] Assignee: The Toro Company, Minneapolis, Minn.

[21] Appl. No.: 465,138

[22] Filed: Feb. 9, 1983

[51] Int. Cl.[3] ..... F01P 1/02

[52] U.S. Cl. ..... 123/41.58; 123/41.7; 37/259

[58] Field of Search ..... 123/41.7, 41.58, 41.66, 123/41.56; 37/196, 246, 259; 56/294

[56] References Cited

U.S. PATENT DOCUMENTS 3,500,620 3/1970 Duran et al. ..... 56/12.8
4,190,972 4/1980 Berner ..... 37/246
4,294,027 10/1981 Edwards ..... 37/259
4,295,285 10/1981 Stevens ..... 37/246

*Primary Examiner*—William A. Cuchlinski, Jr.
*Attorney, Agent, or Firm*—Joseph P. Martin

[57] ABSTRACT

An engine housing assembly (1) has a cover (2) and a body (4). Longitudinal baffles (10, 12 and 17) on cover (2) cooperate with baffles (13, 14, 60 and 61) on body (4) to seal against engine (8), to provide a first chamber (16) adjacent the intake side of the engine, and a second chamber (50) adjacent the exhaust side of the engine. An inlet opening (22) and exhaust opening (24) in body (4) facilitate movement of the air through the housing by fan (45) to restrict recirculation of engine heat in the housing, thus minimizing vapor lock. An opening (33) between baffles (17 and 16) allows a flow of heated air from the exhaust side of the engine over carburetor (44) to minimize carburetor icing.

8 Claims, 6 Drawing Figures

ENGINE HOUSING

TECHNICAL FIELD

This invention relates to a housing for an air-cooled internal combustion engine which is used to power a small hand-held ground care implement, such as a snow thrower or string trimmer.

BACKGROUND OF THE INVENTION

Engine housings for various types of engines are well known. Liquid-cooled engines are usually provided with a radiator containing a heat conducting liquid, a housing of some type usually surrounding the radiator and/or engine and means for connecting the engine and radiator so that the liquid in the radiator is circulated through the engine to absorb engine heat. A fan is usually provided to assist the heat transfer at the radiator.

A housing for an air-cooled engine poses a special problem since the engine is not equipped with a radiator to help dissipate engine heat. In practice, many machines powered by an air-cooled engine have no engine housing at all, and engine heat is allowed to dissipate directly from the engine into the atmosphere. Some examples of these machines are commercial-type filament trimmers, debris blowers, and chain saws.

There are obvious disadvantages to operating an air-cooled engine without a housing of some type; the danger of burns from direct contact with the engine; the danger of starting a fire from contact of the engine with some combustible material; and possible damage to the engine itself, from contact with some other object. In an air-cooled engine, the cooling fins are relatively fragile, and breakage is fairly common where they are exposed. In addition, an exposed engine is not as aesthetically pleasing as a well designed housing.

Some manufacturers of small, gasoline engine powered implements such as trimmers or chain saws, have provided a shroud or partial housing over the engine. However, for dissipating engine heat, a muffler or cooling fins, or both, are normally exposed to the atmosphere, and consequently to the user. Some attempts have been made to provide a housing to fully enclose a small, air-cooled engine. However, until the teachings of the present invention, these attempts have not been totally successful because of the variety of problems which may be encountered over a range of operating conditions. For example, a tiller being operated in an ambient temperature of 90° Fahrenheit may be subject to vapor lock because of recirculation of engine heat in the housing. A snow thrower powered by the same engine in the same housing, operating in an ambient temperature below freezing, may be subject to carburetor icing because of the extremely cold air entering the housing.

SUMMARY OF THE INVENTION

One aspect of this invention is to provide an aircooled engine housing assembly where the engine is enclosed inside the housing. The housing is separated into two chambers; one chamber on the cool, or carburetor, side of the engine and the other chamber on the hot, or exhaust, side of the engine. The housing has means for providing a flow of air into the first chamber, across the carburetor, thence across the cooling fins of the engine where the flow of air picks up the engine heat, and then out of the second chamber to the atmosphere. This helps prevent vapor lock. The housing has a second means for allowing a small amount of heated air from the second chamber to pass back into the first chamber, where it is carried with the incoming air over the carburetor. This temperature balancing effect helps prevent carburetor icing. Thus, this invention provides a housing which can be utilized for a variety of implements over a relatively wide temperature range.

Another aspect of the invention is to provide an engine housing for a light weight, hand-held ground care implement wherein all engine parts are enclosed.

Still another aspect of this invention is to provide a housing which facilitates ease of assembly, by allowing the entire engine assembly to be assembled in the housing as a unit, thereby saving installation time and contributing to reduced cost of the unit.

Yet another aspect of this invention is to provide a housing wherein the cover and body can each be molded in one piece, thus further contributing to ease of assembly and maintenance and a lower cost.

BRIEF DESCRIPTION OF THE DRAWINGS

This invention will be described more fully hereafter in the Detailed Description, when taken in conjunction with the following drawings, in which like referenced numerals refer to like elements throughout.

DETAILED DESCRIPTION

Figure 1:
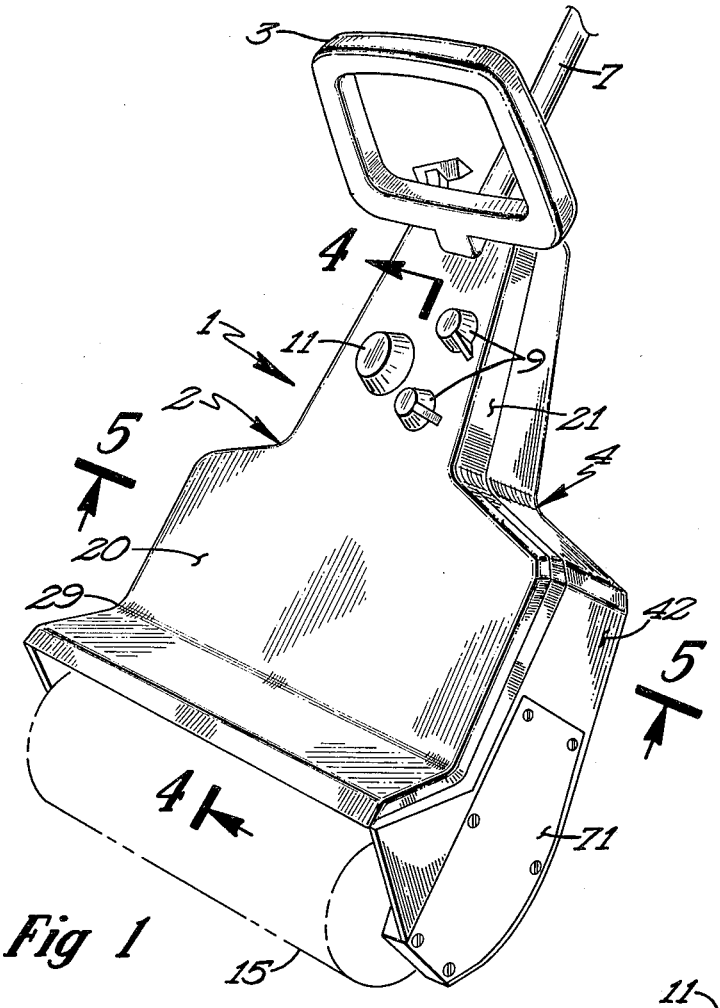
FIG. 1 is a perspective view of the engine-containing housing assembly of this invention, showing the assembly as part of a ground care implement.

In FIG. 1 of the drawings, a housing assembly generally designated as 1 is shown. Housing assembly 1 includes a cover 2 and a body 4. Housing assembly 1 is preferably part of a lightweight hand-held ground care implement. Thus, means are provided for mounting a tubular handle 7 in assembly 1 such that handle 7 carries housing assembly 1 in a weight supporting relationship. Handle 7 is shown broken away and may be of any convenient length. A lower handle grip 3 is also provided in assembly 1, and together with handle 7, is used to manipulate and direct the housing assembly and the working element 15 contained therein. Operating controls 9 and a gas tank 5 with cap 11 are also provided for in assembly 1, but are not essential to this invention, and may be of any configuration and orientation compatible with assembly 1. Cover 2 and body 4 are formed from any suitable material, preferably a light weight material that can be molded, such as high impact plastic or aluminum.

A snow throwing impeller 15, shown in outline in FIG. 1, is rotatably mounted in housing assembly 1. Impeller 15 can have the structure and be mounted in housing assembly 1 all as taught in U.S. Pat. No. 4,295,285, which patent is incorporated herein by reference. Impeller 15 is but one of many working elements that may be utilized with this invention. Others, for example, could be tiller tines, a rotary broom, sanding drum, or any device suited to be driven by a small internal combustion engine. A removable cover 71 provides access to the transmission means (not shown) for the impeller. The transmission means may be meshed gears or a chain or belt drive. Provisions may also be made for mounting a scraper blade, rollers, wheels, or other support means on housing assembly 1, depending on the working element utilized. These support means are not essential to the invention and are not shown.

Figure 2:
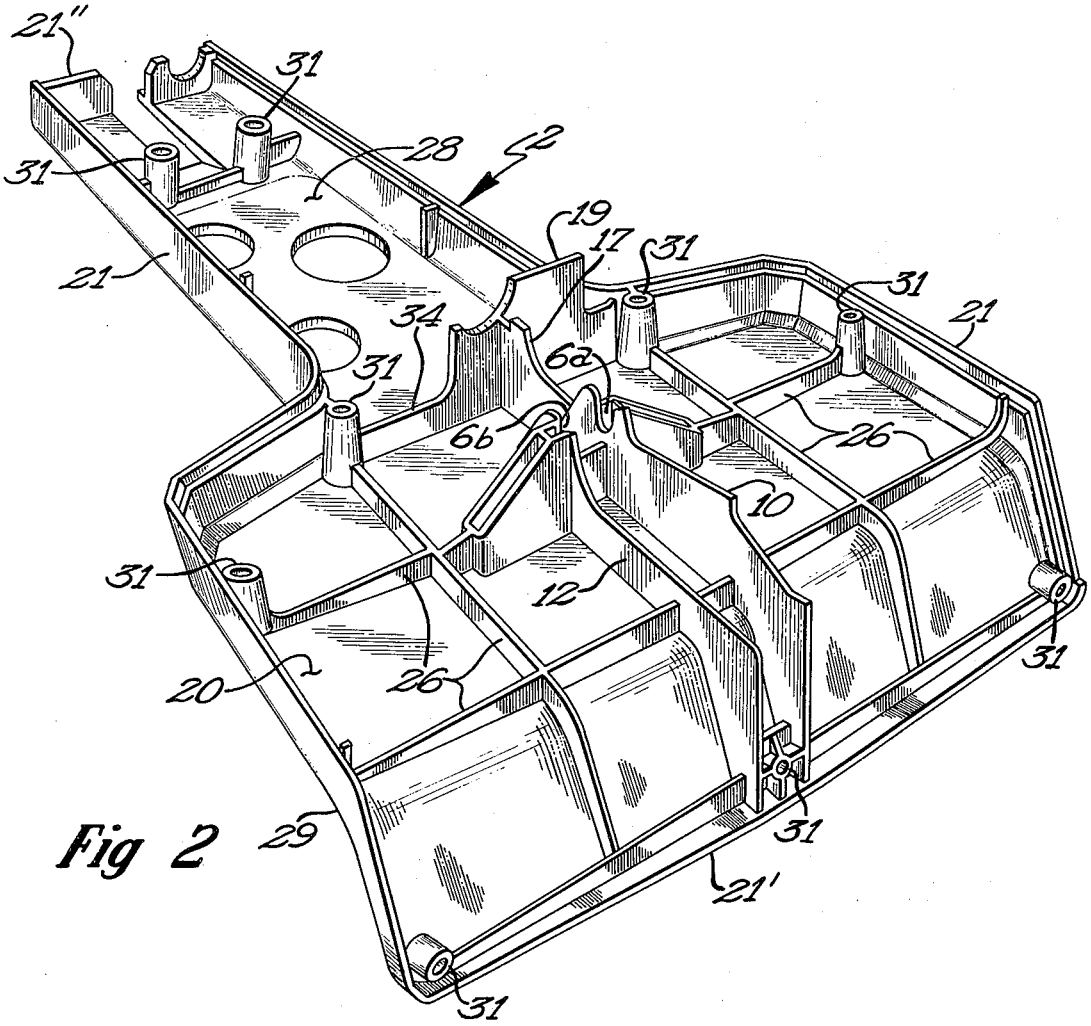
FIG. 2 is a perspective view of the cover portion of the housing assembly of FIG. 1.

Referring to FIG. 2, cover 2 comprises a top wall 20, side walls 21, a front wall 21', and a rear wall 21". Cover 2 also includes a series of stiffening ribs 26, perpendicular to each other, molded integrally on the underside of top wall 20. Cover 2 also includes a neck 28. Neck 28 is adapted to accept tubular handle 7, controls 9, and gas tank 5. In the present embodiment, cover 2 is curved upwardly at the forward end 29 of top wall 20 to correspond with the mating portion of body 4. See FIG. 1.

Cover 2 also includes on the underside of top wall 20 engine mounts 6*a* and 6*b*, transverse baffle 19, and longitudinal baffles 10, 12 and 17. Engine mounts 6*a* and 6*b* include U-shaped recesses or cavities that will face downwardly when cover 2 is installed on body 4. Baffle 19 extends generally across the opening to neck 28. Longitudinal baffle 17 extends between approximately the midpoint of baffle 19 forwardly to engine mount 6*a*. Baffle 10 continues forwardly in the same fore and aft line as baffle 17 to front wall 21'. Baffle 12 is parallel to and to one side of baffle 10, and extends forwardly from engine mount 6*b* to front wall 21'. A plurality of bosses 31 are integrally molded into cover 2 for receiving threaded fasteners 47 which secure cover 2 to body 4.

Figure 3:
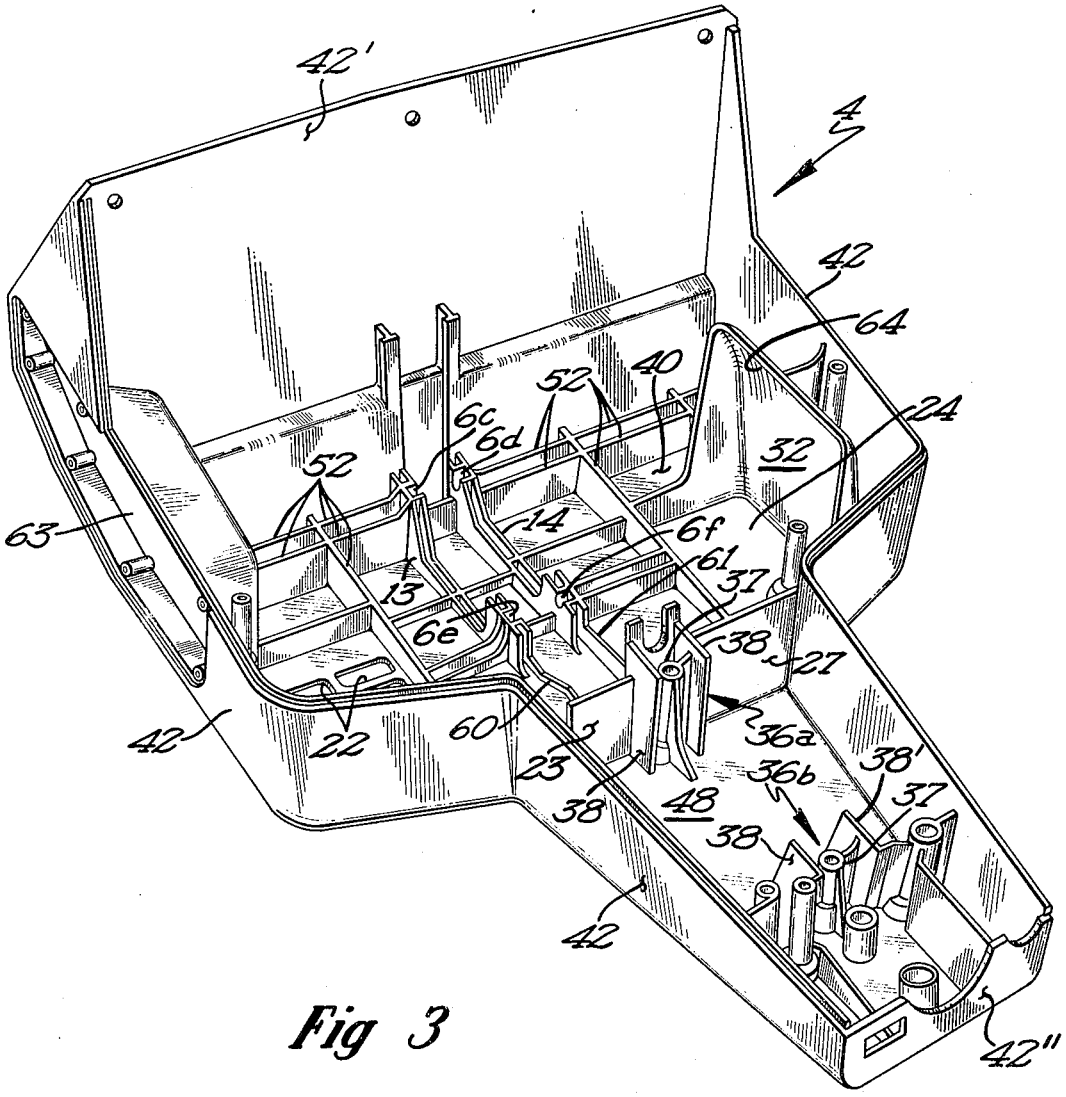
FIG. 3 is a perspective view of the body portion of the housing assembly of FIG. 1.

Referring now to FIG. 3, body 4 is configured to mate with cover 2 and consists of a generally planar bottom wall 40, two upstanding side walls 42, a front wall 42' of substantially greater height than side walls 42, and a rear wall 42". Body 4 has a neck 48 shaped similarly to neck 28 of cover 2. Neck 48 includes handle mounts 36*a* and 36*b* each of which comprises an upwardly extending, threaded boss 37 located between two parallel walls 38 and 38' that form a cradle for handle 7. Handle 7 is adapted to rest between walls 38 and 38' and be secured to body 4 by a screw or bolt 39 extending down through handle 7 into boss 37. See FIG. 4. Body 4 also includes a series of perpendicular stiffening ribs 52 formed integrally on the upper side of bottom wall 40. Engine mounts 6*c*, 6*d*, 6*e*, and 6*f* comprising U-shaped upwardly facing recesses are located on either side of the fore and aft center line of body 4.

As was the case with cover 2, body 4 includes a series of transverse and longitudinal baffles formed on the top side of bottom wall 40. These baffles include transverse baffles 23 and 27 which are aligned with one another but are separated by handle mount 36*a*. When cover 2 and body 4 are assembled together, the transverse baffle 19 in cover 2 mates with transverse baffles 23 and 27 in body 4 to effectively divide the interior of housing assembly 1 into a front, engine carrying compartment A and a rear compartment B that carries gas tank 5 and the operating controls 9 for the engine. See FIG. 4. An opening 34 is provided in baffle 19 to allow the fuel line 53 and the operating cables 54 and 55 from controls 9 to pass from compartment B to compartment A.

Figure 4:
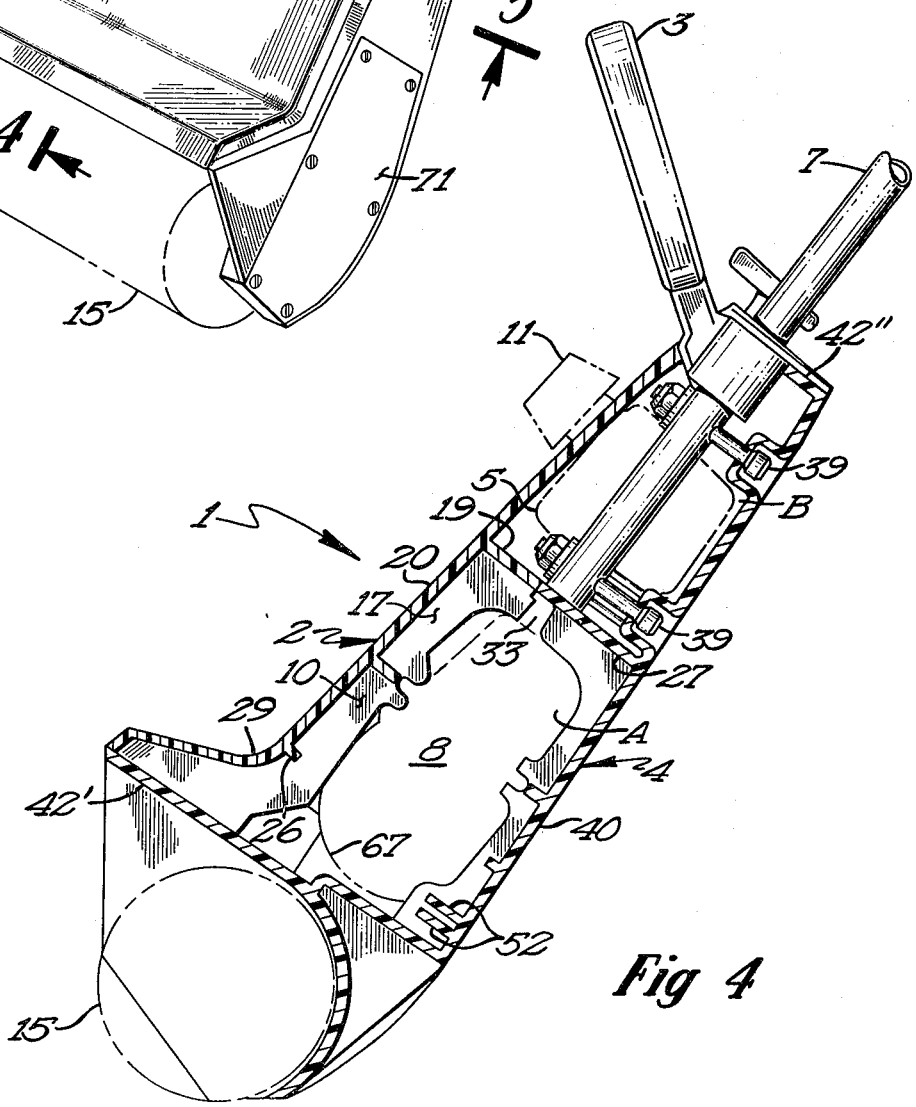
FIG. 4 is a cross-sectional view of the housing assembly of FIG. 1, taken along the lines 4—4 in FIG. 1.

Body 4 also includes two parallel longitudinal baffles 13 extending between mounts 6*c* and 6*e* which taper slightly downwardly toward mount 6*e*. A similar set of baffles 14 are located parallel to baffles 13 but are of a greater vertical height. Baffles 14 extend between engine mounts 6*d* and 6*f* and taper downwardly toward mount 6*f*. Another longitudinal baffle 60 extends between engine mount 6*e* and handle mount 36*a*. Yet another longitudinal baffle 61, of a greater vertical height than baffle 60, extends between engine mount 6*f* and handle mount 36*a*. Baffle 61 will be linearly opposed to baffle 17 when cover 2 is attached to body 4, but baffles 16 and 17 do not meet, thus providing an opening 33 between them, as best seen in FIG. 4. The purpose of opening 33 will be described later. A plurality of inlet slots 22 are located to one side of baffles 13 and 14 and provide openings for incoming air to engine compartment B. Similiary, a large opening 24 on the other side of baffles 13 and 14 provides an exhaust opening for engine compartment B. A deflector 32, mounted adjacent opening 24, has a curved upper end 64 and is downwardly inclined to assist the movement of hot air through exhaust opening 24.

Figure 6:
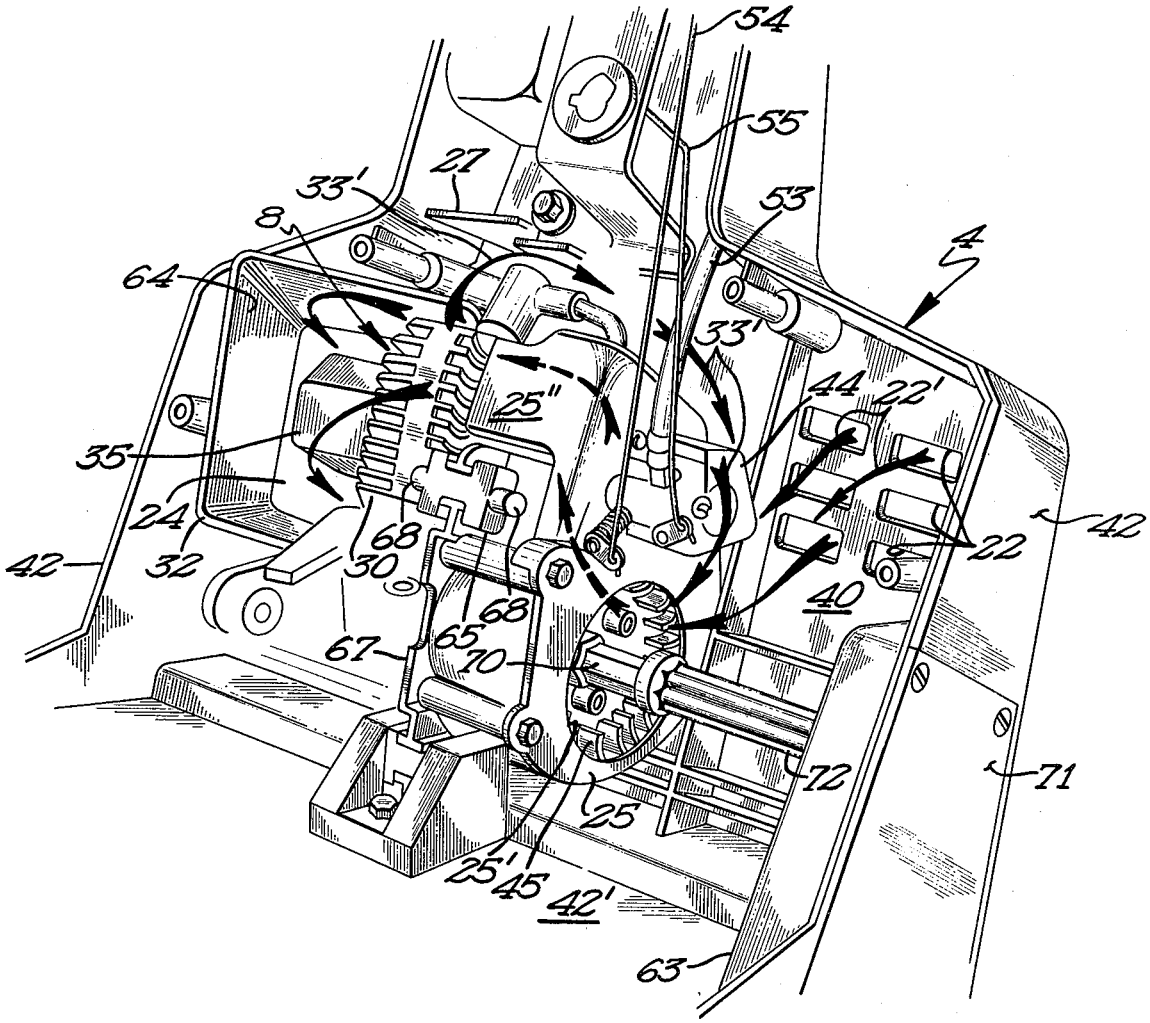
FIG. 6 is a perspective view of the body of the housing assembly of FIG. 1 particularly showing a typical engine (partially in phantom) that may be used with this invention, and the air flow across the engine and through the housing assembly.

An extremely important feature of this invention is the subdivision of engine compartment A into left and right chambers 16 and 50 which are substantially separate from one another and are on opposite sides of engine 8. Referring now to FIG. 6, engine 8, shown partially in phantom, is bolted or otherwise fixedly secured to a backing plate 67. Backing plate 67 includes a plurality of slots which accommodate resilient mounting blocks 65 having outwardly protruding ears 68. Ears 68 are suited to be received in the recesses defined by each of the engine mounts 6*a*–6*f* simply by sliding the blocks 65 downwardly with each ear 68 being engaged in one recess. The use of these resilient blocks 65 and this type of mounting system is more particularly shown in U.S. patent application serial number 255,571, filed Apr. 20, 1981, now U.S. Pat. No. 4,391,041 which application is incorporated herein by reference. Such resilient mounting blocks help isolate the vibration of engine 8 from the housing assembly 1, thereby enabling the implement to be more easily manipulated by the operator.

In any event, as shown in FIG. 6, engine 8 is fixedly coupled to the backing plate 67. Engine 8 has a combustion chamber 18 on the exterior of which a plurality of cooling fins 30 are formed. A carburetor 44 is located on engine 8 generally on the same side as the inlet slots 22. Carburetor 44 feeds fuel to the engine in a known manner. Engine 8 also includes a flywheel fan 45 that sucks air through an engine shroud 25 on one side of the engine. The purpose of the flywheel fan is to draw air into the housing assembly 1 for both cooling the engine and also ensuring the air is delivered adjacent carburetor 44 for the proper mixing of air and gasoline. Shroud 25 has a circular opening 25' for admitting air beneath the shroud and a transversely extending deflector portion 25" that then conducts this air to a position immediately adjacent cooling fins 30. From there most of the air can pass downwardly through cooling fins 30 to remove engine heat and eventually will exit through exhaust opening 24. A small amount of heated air is directed back into the first chamber 16 through opening 33. This heated air mixes with the air incoming through slots 22 and passes directly over carburetor 44 and thence back through opening 25' and again across cooling fins 30.

A drive shaft 70 and drive shaft extension 72 extend outwardly from engine 8 into a recess 63 on one of the side walls 42 of body 4. There, the drive shaft extension 72 is coupled to the transmission means for rotating the working element of the implement, i.e. snow throwing impeller 15.

Engine 8 is adapted to be installed into the body 4 of housing assembly 1 after it has been fixed to a mounting plate 67 by simply slipping the mounting blocks 65 into the appropriate engine mounts 6c–6f in body 4. After this has been done and after the fuel line and controls leading from the compartment A have been connected to engine 8, cover 2 may be mated to body 4. During this procedure, the remaining blocks 65 on backing plate 67 are slipped into the engine mounts 6a and 6b on cover 2 as cover 2 is placed over body 4. When cover 2 and cover 4 are then secured together by threaded fasteners 47, the side walls and the front walls of the cover and body will mate with one another to form the enclosed housing assembly 1. In addition, the transverse baffles 19, 23 and 27 will mate so that the housing assembly is further subdivided into the front engine compartment A and rear compartment B. Moreover, the longitudinal baffles have been designed to mate with the various parts of the engine to further subdivide the engine compartments A into a first chamber 16 adjacent the flywheel side of the engine and a second chamber 50 adjacent the exhaust side of the engine. Thus, referring to FIGS. 2 and 5, one sees that the longitudinal baffles 13 and 14 on the body 4 will abut against and mate against various portions of the engine assembly and this is true also of the longitudinal baffles 10 and 12 on the cover 2. These baffles in conjunction with the engine structure itself collectively define a central medial wall subdividing engine compartment A into left and right chambers 16 and 50. An opening for air to pass from chamber 16 to chamber 50 is the air flow path located underneath engine shroud 25 and through cooling fins 30. In other words, the air flow from chamber 16 into chamber 50 is the air which is drawn in by the flywheel fan 45 and dispatched beneath engine shroud 25. See FIGS. 5 and 6. Opening 33 between longitudinal baffles 17 and 61 allows a small flow of air, now heated, from second chamber 50 back into the first chamber 16. Opening 33 acts as a secondary air flow passageway, as incoming air pulled by fan 45 into the housing through slots 22 rushes past opening 33, the heated air is sucked into the incoming air stream, and provides a temperature balancing effect on the incoming air as it flows past the carburetor. This temperature balancing effectively prevents carburetor icing when operating at ambient temperatures near or below freezing.

Figure 5:
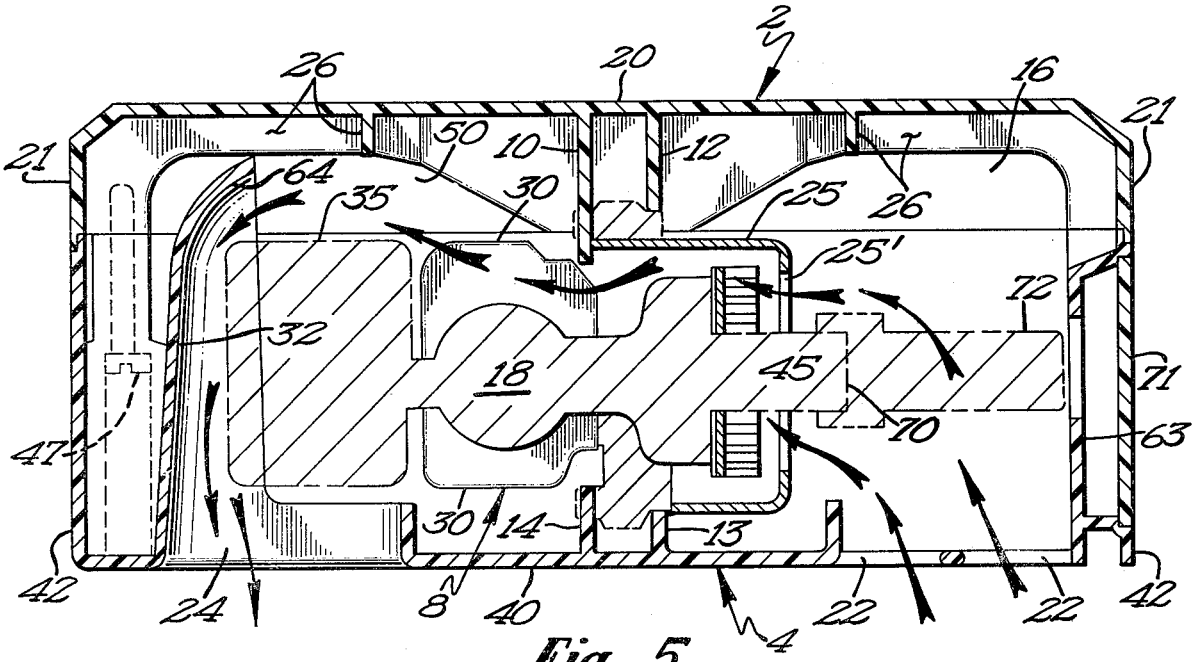
FIG. 5 is a cross-sectional view of the housing assembly of FIG. 1, taken along the lines 5—5 in FIG. 1, particularly showing air flow into and out of the housing assembly.

Referring now to FIGS. 5 and 6, various arrows will illustrate the air flow through housing assembly 1. When the engine 8 is running, the flywheel fan 45 will pull outside air into housing assembly 1 through inlet slots 22. This air then enters the engine 8 beneath the engine shroud 25 and will pass generally transversely across the engine (arrows 22') and through the central medial wall defined by the longitudinal baffles. As the air passes in this manner some is first used for mixing in the carburetor 44 so that the combustion process can take place. Thereafter, most of the remainder of the air will pass down and across the cooling fins 30 and muffler 35 of the engine picking up heat from the engine. When the air leaves the fins 30 and muffler 35, it will be deflected downwardly and out of housing assembly 1 through the exhaust opening 24 by the deflector 32. The curved portion 64 of deflector 32 helps direct the air downwardly and out opening 24. A portion of the air passes across the fins 30 and is returned (now heated) back to chamber 16 through opening 33 as previously explained to balance the temperature of the air passing over the carburetor (arrows 33').

Housing assembly 1 according to the present invention has numerous advantages. A subdivision of the housing assembly into an engine compartment having left and right chambers 16 and 50 is important. Chamber 50, in cooperation with the baffles, shrouding 25, deflector 32 and fan 45 provides a rapid evacuation of engine heat from the housing. Since this heat does not recirculate through the housing, except for the small controlled amount through opening 33, the air which enters the carburetor 44 is relatively cool air drawn in through openings 22. This cool air can mix in the carburetor without any danger of vapor lock. Vapor lock is a condition in which the fuel is prematurely vaporized by ambient heat and air bubbles form in the fuel line and block the flow of fuel to the combustion chamber, thus killing the engine. Since the engine heat is effectively evacuated and relatively cool ambient air is being drawn into chamber 16, vapor lock does not occur.

The subdivision of the housing assembly into separate chambers 16 and 50 with a small opening 33 between chambers also provides that a controlled amount of the heat on the exhaust side of the housing gets recirculated back to the cool incoming air to be directed over the carburetor. When operating at ambient temperatures near or below freezing, this flow of heated air across the carburetor prevents carburetor icing. Vapor lock is substantially eliminated in this type of housing when operating in normal or above normal ambient temperatures. Carburetor icing is virtually eliminated when operating at below normal operating temperatures, as with a snow thrower. Thus, the housing of this invention leads itself to use with a wide variety of implements over a wide range of ambient temperatures.

The use of a substantially enclosed internal combustion engine in a hand held implement is also advantageous, because the possibility of burns to the operator are now largely eliminated.

Various modifications of this invention will be apparent to those skilled in the art. Thus, the scope of this invention is to be limited only by the appended claims.

I claim:

1. An engine housing for use with an internal combustion engine having a carburetor, flywheel fan, a combustion chamber and cooling fins therefor, an intake side for supplying fuel and air to the combustion chamber, and an exhaust side adjacent the cooling fins of the combustion chamber which receives heat radiated from the engine and the exhaust gases from the combustion chamber, which comprises:

(a) a housing assembly having a hollow compartment in which an engine is mounted and which substantially encloses the engine to prevent any contact between the engine and an operator;

(b) means for dividing the engine compartment into substantially separate left and right chambers with the left chamber being adjacent the intake side of the engine and the right chamber being adjacent the exhaust side of the engine such that a first air flow path from the left chamber to the right chamber is through the engine structure itself wherein the air is heated by engine heat, and whereby said dividing means greatly restricts recirculation of heated air from the exhaust side to the intake side; and (c) a second air flow path from the right chamber to the left chamber, whereby a small flow of heated air from said exhaust side of the engine is recirculated through said intake side and directed past the carburetor.

2. An engine housing as recited in claim 1, wherein the dividing means comprises a central medial wall having a top portion and bottom portion which are respectively sealed against the engine.

3. An engine housing as recited in claim 2, wherein the housing assembly is formed by a separate body and cover which are releasably joined together.

4. An engine housing as recited in claim 3, wherein the top portion of the central medial wall is contained on the cover and the bottom portion of the central medial wall is contained on the body.

5. An engine housing as recited in claim 4, wherein the top portion of the wall is formed by a plurality of longitudinal baffles in the cover, and the bottom portion of the wall is formed by a plurality of longitudinal baffles in the body, wherein said baffles cooperate with said engine to define said right and left chambers.

6. A powered ground care implement which comprises:

(a) a working element for performing a working action on the ground;

(b) a handle assembly on which the working element is carried;

(c) an air-cooled internal combustion engine for driving said working element, wherein said engine has a combustion chamber and cooling fins therefore, an intake side for supplying fuel and air to the combustion chamber, an exhaust side adjacent the cooling fins of the combustion chamber which receives the exhaust gases from the combustion chamber, a carburetor, and a flywheel fan;

(d) a housing assembly substantially enclosing said engine, wherein said housing comprises:

(i) a cover having a top wall and side walls;

(ii) a body having a bottom wall and side walls;

(iii) baffles in said cover and body which cooperate with said engine and said walls to form a first chamber on said intake side of the engine, and a second chamber on said exhaust side of the engine, when said cover and body are joined together to form said housing; and (e) means for directing a flow of air through said housing.

7. A powered ground care implement as recited in claim 6, wherein said air flow directing means further comprises:

(a) said bottom wall of said body having an inlet communicating said first chamber with the atmosphere to allow the introduction of air into the first chamber;

(b) said bottom wall also having an exhaust opening communicating said second chamber with the atmosphere to allow the expulsion of said air and exhaust gases;

(c) a first air flow passageway defined by said inlet, said baffles and said exhaust opening, through which can pass an air flow generated by said fan when said implement is in operation, whereby said air flow picks up heat from combustion as said air flow passes through said housing and thence out said exhaust opening, thereby resticting the recirculation of said heat in said housing, thus minimizing vapor lock; and (d) a second air flow passageway defined by said baffles, through which a small flow of heated air from said second chamber is directed back to said first chamber, and thence past said carburetor thus minimizing carburetor icing.

8. A ground care implement as recited in claim 7, wherein said air flow directing means further includes a deflector in said second chamber to assist in evacuation of said air from said housing.

* * * * *